United States Patent [19]

Sarfati et al.

[11] 3,994,447

[45] Nov. 30, 1976

[54] DELIVERY DEVICE FOR RUNNING THREADS

[75] Inventors: Alberto Gustavo Sarfati, Busto Arsizio; Giuseppe Vischiani, Como; Massimiliano Bianchi, Gravedona, Como, all of Italy

[73] Assignee: Sobrevin Societe de Brevets Industriels Etablissement, Vaduz, Liechtenstein

[22] Filed: Apr. 7, 1975

[21] Appl. No.: 565,378

[30] Foreign Application Priority Data

Apr. 10, 1974 Germany ..... 2417440

[52] U.S. Cl. ..... 242/47.12; 66/132 R; 139/429

[51] Int. Cl.² ..... B65H 51/20

[58] Field of Search ..... 242/47.12, 47.01; 66/132 R; 139/122 R

[56] References Cited

UNITED STATES PATENTS

| | | | |
|---|---|---|---|
| 3,637,149 | 1/1972 | Frei | 242/47.12 X |
| 3,782,661 | 1/1974 | Deniega et al. | 242/47.12 |
| 3,796,386 | 3/1974 | Tannert | 242/47.12 |
| 3,858,830 | 1/1975 | Deniega et al. | 242/47.01 |

*Primary Examiner*—Stanley N. Gilreath
*Attorney, Agent, or Firm*—Martin A. Farber

[57] ABSTRACT

A delivery device for running yarn with a winding body to which the thread feeds in the range of a conical extension for the formation of a rewinding stock, the latter being displaced rearwardly and removable over head. At least one stay is arranged in crossing overlapping relation to the extending of the angle channel between the conical extension and a winding body section connected thereto.

11 Claims, 6 Drawing Figures

5'
10
x 5
13
F1
22
12
11
29
K
19
u
x
21'
F2
21
20
21''
16

13
5
5'
F2
12
11 z
F1
10
21

DELIVERY DEVICE FOR RUNNING THREADS

The invention relates to a delivery device for running yarn with a winding body to which the thread feeds in the range of a conical extension for the formation of a rewinding stock, the latter being displaced rearwardly and removable over head.

Corresponding devices are known by German patent 1,262,847. The winding body (or spool) is thereby formed as a cylindrical drum which has the conical widening or extension in the form of a frustoconically formed feed surface. The thread or yarn feeding in the range of this feed surface glides off the same and advances the previously feeding thread winding by pressing in the angle point line of the angle channel between the frustoconically formed feed surface and the cylindrical drum surface.

Corresponding devices have been used, for example, as weft thread-intermediate stock for web machines with stationary weft thread-supply spools, A control device coordinated to the apparatus guarantees thereby that the thread length to be drawn off from time to time is present as rewinding stock. With corresponding devices not only is a high through-put capacity achieved, but also a large constancy in the thread removal tension.

Corresponding devices are also known with rotating spools or winding bodies and stationary thread feeding locations, as well as with rotating thread feed locations and stationary winding bodies. There are difficulties with these known devices to process practically all the different yarn types which occur today on the market, always with equally large through-put capacity and clean thread removal. This applies in particular when it relates to corresponding devices with stationary winding bodies and rotating thread feed locations. With particular yarns the centrifugal forces of great consequence which affect the feeding yarn lead to certain irregularities in the formation of the rewinding device and to further disturbances in the manner of operation of the device.

Already various attempts have been undertaken to improve the suitability of corresponding devices for a greater palette of the yarn which occurs on the market.

Thus, for example, German Offenlegungsschrift 1760,738 proposed in this respect to make the thread feed location adjustable back and forth relative to the winding body parallel to the axial direction thereof.

This permits a change of the entering or feed angle of the thread in the angle channel between the conical extension and the cylindrical winding body section. Yet this solution does not disclose the possibility to process the yarn of most different qualities and types on corresponding devices. The lip angle for pressing on the thread is indeed allowed to change; however, the line of the first running on thread winding remains always the same and corresponds exactly to the course of the angle point line of the angle channel between the conical extension and the section of the winding body connected thereon.

By one other attempt at a solution of the enumerated disadvantages one has done without effectuating the feeding of the rewinding device on the winding body exclusively by means of the thread feed. Contrariwise, active push-type acting feeding means have been provided (compare German Auslegeschrift 1,635,899 and German Offenlegungsschrift 2,035,754). By the solution according to Geraman Offenlegungsschrift 2,035,754, the winding body is formed of rods seated on the corners of a polygon, and the feed pushing member acts therebetween. These devices are expensive in commercial construction. They extend a moved part for the feed. On the other hand, they bring yet the advantage of slight displacement friction, because the thread windings do not abuttingly engage all around on the winding body.

Finally one has already tried to increase the possibility of use of the introductory mentioned generic type devices for the most different yarn types and yarn qualities, in the manner that one selects different winding bodies, each according to the nature or condition of the yarn to be worked, particularly according to its elasticity. These winding bodies are thus formed such that, connected on the conical extension there occurs a further slightly conically converging part, on the other side of which part the substantially cylindrical jacket surface of the winding body first starts (German patent Auslegeschrift no. 1,535,642). This solution is extremely disadvantageous for commercial production as well as for the storage level or holding. The angle of the slightly sloping conical part must be adjusted relatively exactly to the respective yarn and the thread feed tension. Each delivery or feed device is provided practically only for a predetermined yarn. For structurally other type yarns, other winding bodies must be produced with another inclination angle of the slightly concially converging cooperatively running part.

With these devices, the feed line is the angle point line between the strongly sloping conical extension and the slightly sloping conical converging part, and every thread winding lies all around on the jacket surface. In particular, with non-elastic and thin yarns, there occurs the danger that the yarn windings which have formed the rewinding stock on the cylindrical part slip or shift, which furthermore can lead to removal difficulties.

It is an object and task of the present invention to develop a device of the introductory mentioned type such that with commercial production of favorable and application advantageous construction, there is provided the most favorable geometric proportion in the range of the winding-on line.

This task is solved in accordance with the invention in accordance with another object thereof by providing a delivery device for running yarn comprising a winding body to which the thread feeds in the range of a conical extension for the formation of a rewinding stock, the latter being displaced rearwardly and removable over head, in the manner that at least one stay is arranged in crossing overlapping relation to the circumferential direction of the angle channel between the conical extension and a winding body section connected thereto.

Other objects of the present invention are to provide other advantageous solutions in accordance with the embodiments of the dependent claims.

Due to such constructions a feed or delivery device according to the introductory type is provided of increased service value. By means of the stay or stays, during the winding-on every winding is divided in feed sections and slide-off sections, which sections join each other in the circumferential direction of the winding. The feed sections, which continuously lie next to each other at equal height and which are to be determined in their length by positioning of the stays, guarantee that yarn positions are attained which always exactly lie next to each other on the winding body. The yarn positions can not slip or slide over each other, becuase already the first wound-on thread winding is not slidably loaded or biased in the range between the stays, but rather is deposited there in the angle channel. To the contrary the slide-off sections facilitate a uniform feed of the yarn windings. By the adjustment of the stay or stays, the lengths of the feed sections are permitted to adjust to that of the slide-off sections. This brings about an adjustment and adaptation to the different yarn qualities and yarn types relating to only a single delivery device. The circumferential length of the winding body is variable in the range of the thread feed line. This brings therewith also considerable economic advantages. The adjustment of the feed section length for the slide-off section, which adjustment is to be undertaken by the manufacturer with the same equal construction parts or with the existence of an adjustment handle, under certain circumstances by the user, brings always the favorable conditions for a safer disturbance-free removal-favorable storing of the positions of the yarn on the winding body. The conical extension-section on the other side of the stay and the section between two stays, respectively serves, according to arrangement of the stays, yet only partly as an active feed channel for the displacement of the yarn winding, the latter which is to be guided in the thread feed line. The previously mentioned fact is still favored in the manner that the conical extension is formed frustoconically. Then, namely, a maximum variation of the length of the feed channel is provided. The advantageous formation of the stays engage in a concealed position with respect to the winding body. It is recommended to provide the stays in equal peripheral distribution, thus under formation of an equilateral polygon. By a corresponding number of polygon corners additionally still the length of the feed channel of the conical extension is determined. The amount of projecting of the stays can be determined in simple manner by means of axial displacement of the carrier which receives the stays, for example, in the manner that a screw spindle acts on the carrier. The corresponding alignment of the stays according to this adjustment of the carrier leads to a fixed thread feed line in which the being brought-on thread enters. In addition to an axial displacement of the stays for variation of the thread feed line, likewise a radial setting of the stays, is possible. In the latter case, with an adjustment the inclination angle of the stays is varied relative to the conical extension, yet within such limits that the inclination of the stays is smaller than that of the conical extension.

According to need, the stays are permitted to be brought into an ineffective position in the previous types of adjustments, such that then the thread feed line coincides with the angle channel. In this position the device operates exactly as that of German patent 1,262,847.

With these and other objects in view which will become apparent in the following detailed description, the present invention will be clearly understood in connection with the accompanying drawings, of which:

Figure 1:
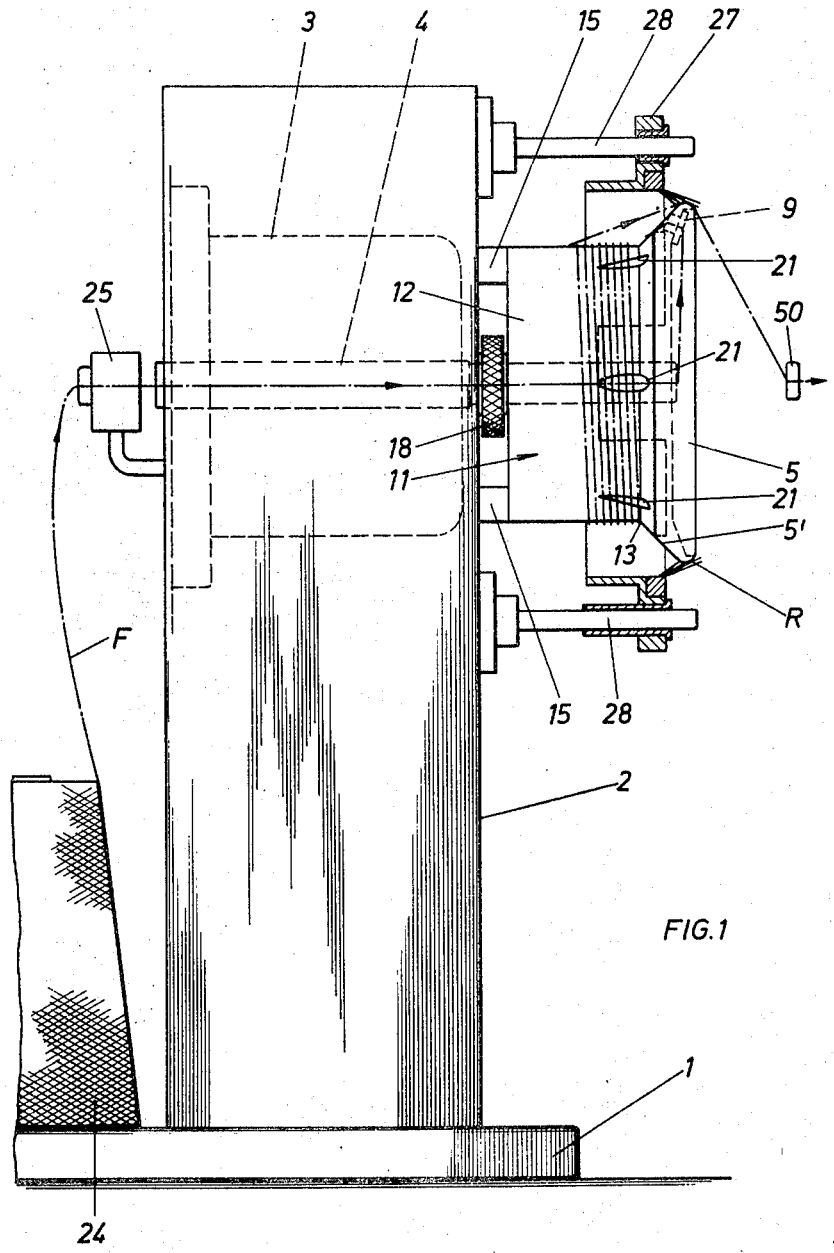
FIG. 1 is a schematic view of a first embodiment of the invention.

Referring now to the drawings, and more particularly to FIGS. 1 – 5, the delivery or feed device of the present invention, as illustrated comprises a housing 2 carried by a base plate 1. An electromotor 3 is arranged in the housing 2, the motor shaft 4 thereof receiving a disc shaped thread eye carrier 5. For this purpose the thread eye carrier 5 possesses a slitted cone 6, which is seized thereover by a disc 7 having a conical inner opening. The forced connection is brought about by screws 8.

The thread eye carrier 5 has a conical wall 5' of the type such that the conical course reduces in the direction toward the housing. The thread eye opening in the conical wall 5' of the thread eye carrier is designated with the reference character 9.

The conical wall 5' of the thread eye carrier 5 is aligned flush with the conical extension 10 of the winding body 11. The section 12 of the winding body 11 connects on the conical extension 10, the latter being formed in this embodiment as a truncated cone. In the present case the section 12 constitutes the cylindrical drum wall of the winding body. The angle between the conical extension 10 and the jacket surface of the winding body 11 is designated with the reference character 13.

The drum wall which is formed as the jacket surface of the winding body continues on the end adjacent to the housing 2 in an inwardly directed collar 14. The latter serves for the fastening of the winding body on the housing, and indeed by the use of spacers 15 arranged in uniform circumferential distribution. The tube shaped cylindrical carrier is seated longitudinally displaceably in the winding body 11. A screw spindle 17 is secured in the carrier 16, which screw spindle 17 carries an adjustment nut 18 in the space between the collar 14 and the housing 2. An axial change of length or position of the carrier 16 can be brought about by turning the nut 18.

On its end pointing toward the thread eye carrier 5, the carrier 16 devolves into a conically shaped section 19, which enters in a complementary fitting conical recess of the winding body 11.

Bores 20 are provided in the carrier 16, which bores are aligned at an acute angle inclination relative to the axis line of the winding body, the bores 20 serving for the reception of correspondingly length dimensioned stays or bors 21. According to the first embodiment example, the stays 21 are formed as round or cylindrical bodies. These found body stays 21 are set through corresponding slots of the winding body. The slots 22 enter in the range between the frustoconical, or truncated cone, surface 10 and the jacket surface 12 of the winding body 11. That means that the stays 21 lie in crossing overlapping relationship relative to the circumferential direction of the angle channel 13 of the winding body. In the embodiment example, the carrier 16 is located in such a position in which the stays 21 project a certain measure or extent over the angle channel 13. As particularly evident in FIGS. 2 and 4, the one end 21' of the stay 21 enters in the frustoconical surface 10, and the other end 21'' enters in the drum wall 12, with avoidance of disturbing projections.

The thread eye carrier 5 which is aligned coaxially to the winding body 11 is equiped with a recess channel 23 on the outlet side of the thread eye 9, which forms a support edge 23' for the thread F which is to be brought on the winding body 11.

The thread F is drawn off the supply spool 24, the latter which is seated on the base plate 1. It runs through, thereby, a thread brake 25 which is located on the opposite side of the housing. From there the thread proceeds across the bore 26 of the motor shaft 4 into the thread eye 9 and from there it is brought out on the winding body 11. The removal of the thread from the winding body 11 takes place over the rounded extreme edge R of the thread eye carrier 5, which extreme edge is coordinated to the brake ring 27, the bristles of which step in contact to the extreme edge of the thread eye carrier 5. The brake ring 27 is seated on its side coaxially to the winding body 11, displaceably on guide pins 28 freely originating from the housing 2, and is fixable in any position by means of clamping elements (not shown). From the braking ring 27, the thread proceeds into the thread withdrawal eye 50.

Figure 2:
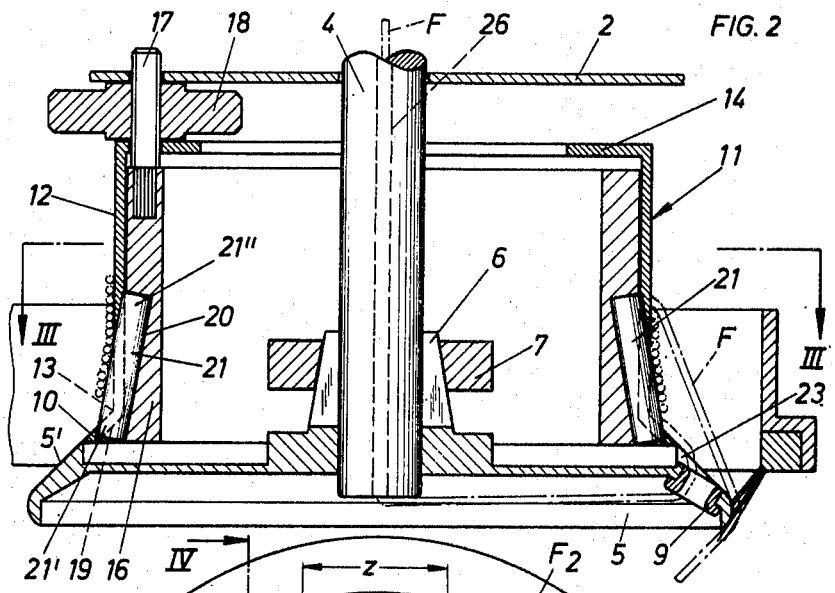
FIG. 2 is a longitudinal section through the winding body or spool.
Figure 3:
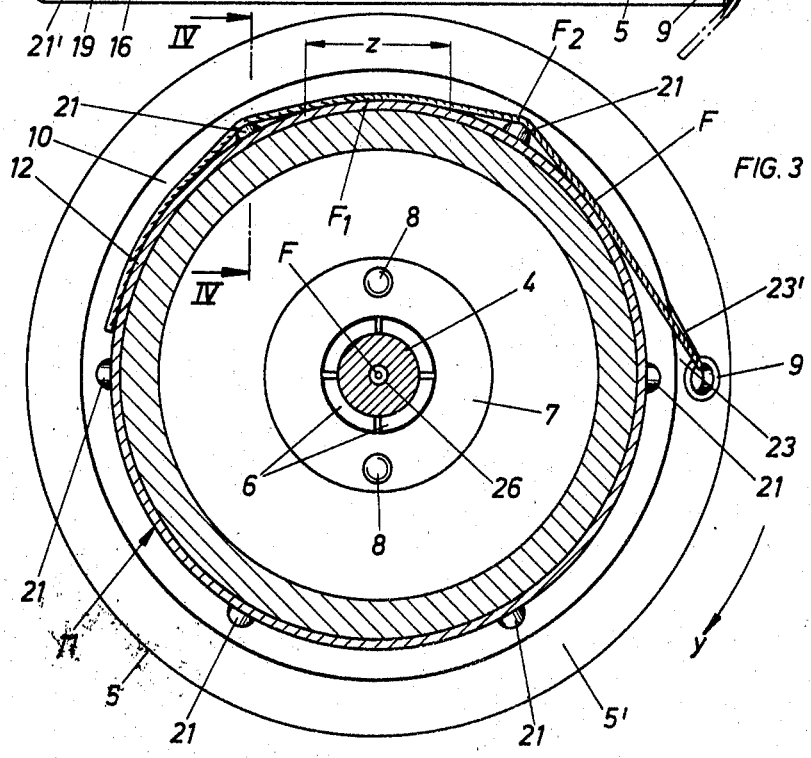
FIG. 3 is a section taken along the lines III — III of FIG. 2.
Figure 4:
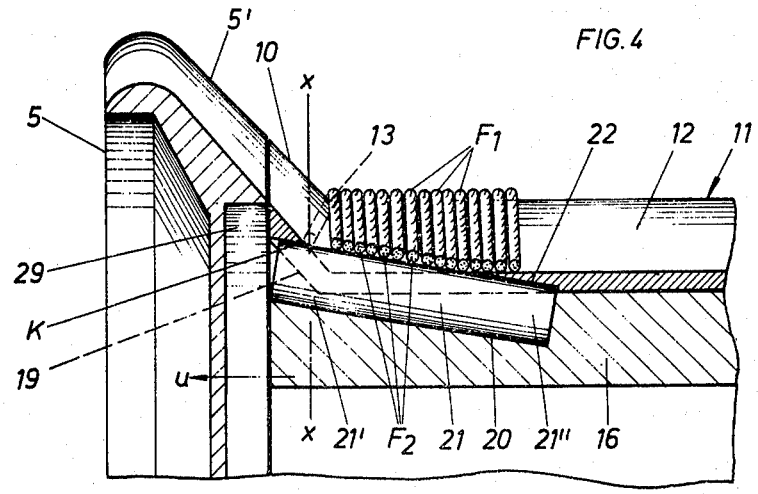
FIG. 4 is an enlarged section taken along the lines IV — IV of FIG. 3.
Figure 5:
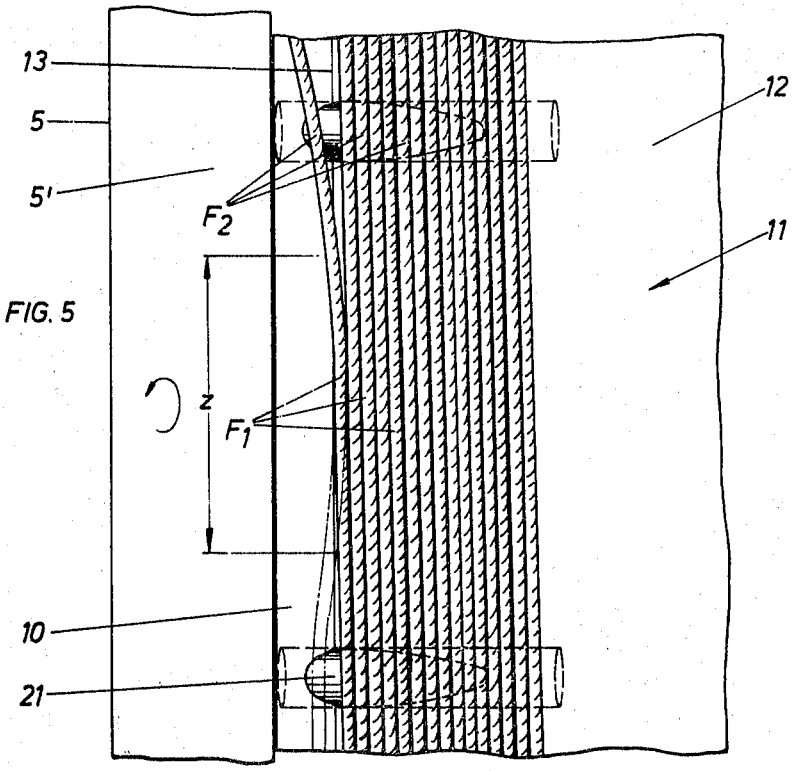
FIG. 5 is a plan view of FIG. 4.

As evident from FIGS. 1 and 2, the thread removal direction is opposite to the feed direction of the yarn winding. During bringing on of the yarn positions the thread portion leaving the thread eye 9 proceeds to the thread feed line X—X. The latter is formed from the ridge channel K between the stays 21 and the frustoconical surface 10. With further rotation of the thread eye carrier 5 in the arrow direction *y*, the range of the frustoconical surface 10 lying between the corresponding stays 21 forms a feed segment *z*, which displaces the corresponding portion of the yarn winding in the direction of the angle channel 13. In the winding up zone, the yarn windings are thus brought on polygonally. The polygon corners are formed on the one hand by the stays 21 and on the other hand by the corresponding jacket section of the drum wall. The yarn windings applied thus in the winding zone become correspondingly divided in feed section F1 lying on the winding body section 12 and in the slide off section F2 located on the stays 21. In this manner it is achieved that yarn positions lying exactly next to one another occur completely equal, making no difference which material is involved. If for instance the thread course line X—X be displaced, thus the carrier 16 having the stays can be displaced in the direction of the arrow *u* by means of the adjustment nut 18, whereby the corresponding end section of the carrier 16 enters in a recess 29 of the thread eye carrier 5.

Instead of the previously described embodiment form, the winding body could be formed of coaxially arranged polygonal bodies lying angularly displaced or offset relative to each other. One body forms the stays and the other body forms the winding body section. Also an embodiment of the delivery or feed device is possible by which the stays are rigidly coordinated to the winding body. Then the displacement device with carrier could be omitted. Nevertheless, if a larger holder or application range is possible, then with larger inclination position of the stays, the guarantee is provided that yarn positions do not slip or slide over each other.

Figure 6:
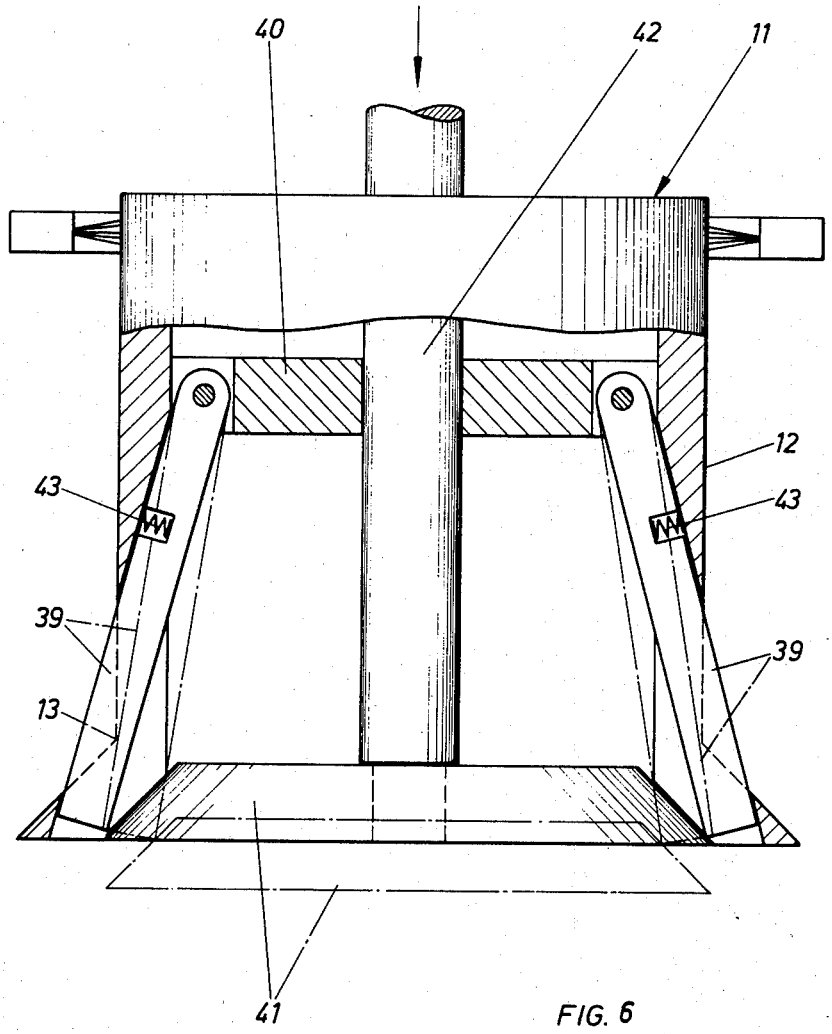
FIG. 6 is a schematic longitudinal section through the winding body in accordance with a second embodiment of the invention.

Referring now again to the drawings, and more particularly to FIG. 6, according to a second embodiment form of the present invention there is provided a radial advancement of the stays 39. For this purpose one-armed stays 39 are carried in uniform circumferential distribution on a non-displaceable annular piece 40 of the winding body, the free ends of the stays 39 pointing toward the conical extension. The jacket surface of the winding body and the conical extensions are formed with slots for this purpose. The stays 39 are spring-loaded in an inward direction by a compression spring 43 each. A cone 41 serves from time to time for the radial pivoting of the stays 41, the cone being acted upon by a spindle 42. According to the embodiment form, it is possible to set the stays back from their crossing position to the angle channel 13.

For example, a mechanical control device or a control device operating in the form of a light gate can be coordinated to the winding body with both embodiment forms, the take of which light gate is to scan the wound-on supply on the winding body 11 and to control the drive such that nearly always a predetermined wound-on supply is present on the winding body.

In the illustrated examples the winding body stands still and the thread guide turns. The solution according to the present invention, however, is also applicable with such devices in which the thread guide stands still and the winding body rotates.

While we have disclosed several embodiments of the invention, it is to be understood that these embodiments are given by illustration only and not in a limiting sense.

We claim:

1. A delivery device for running threads comprising a winding body defining a head end and having a conical extension and including means for feeding thread thereto in a range of said conical extension to form a thread winding stock which is displaceable in a direction away from said conical extension and being removable over the head end.

said winding body having a winding body section connected to said conical extension and defining an angle channel extending in a circumferential direction between said conical extension and said winding body section, a plurality of stays circumferentially spaced around said winding body all of which simultaneously being adjustably disposed in crossing projecting overlapping arrangement relative to said angle channel, from a zero to a maximum crossing projecting overlapping arrangement, and means for fixedly adjusting said stays in position between said zero to said maximum crossing projecting overlapping arrangement relative to said angle channel, whereby the extent said stays project into said angle channel is adjustable to change the effective circumferential length of said angle channel for thread windings of the running threads thereon engaging all of the stays when the stays are adjusted to project into the angle channel forming slid-off thread sections of the thread windings thereon.

2. The delivery device, as set forth in claim 1, wherein said plurality of said stays are aligned at corners of an equilateral polygon.

3. A delivery device for running threads comprising a winding body defining a head end and having a conical extension and including means for feeding thread thereto in a range of said conical extension to form a winding stock which is displaceable in a direction away from said conical extension and being removable over the head end, said winding body having a winding body section connected to said conical extension and defining an angle channel extending between said conical extension and said winding body section, and at least one stay disposed in crossing overlapping arrangement relative to said angle channel, said conical extension forming a frustoconical surface, said winding body section having a jacket surface which forms a drum wall, said at least one stay having one end which enters in said frustoconical surface, and another which enters in said drum wall.

4. A delivery device for running threads comprising a winding body defining a head end and having a conical extension and including means for feeding thread thereto in a range of said conical extension to form a winding stock which is displaceable in a direction away from said conical extension and being removable over the head end, said winding body having a winding body section connected to said conical extension and defining an angle channel extending between said conical extension and said winding body section, at least one stay disposed in crossing overlapping arrangement relative to said angle channel, said winding body defining an axis, a carrier disposed in said winding body, said at least one stay being disposed in said carrier and inclined at an acute angle relative to said axis of said winding body, and means for adjusting said carrier in the axial direction of said winding body.

5. The delivery device, as set forth in claim 1, wherein said conical extension and said plurality of stays define angles of inclination, respectively, relative to an axis of said winding body, and said angles of inclination of said plurality of stays are smaller that of said conical extension.

6. The delivery device, as set forth in claim 1, wherein said means for fixedly adjusting said stays in position comprises means for setting said plurality of stays in a radial direction relative to said winding body.

7. A delivery device for running threads comprising a winding body defining a head end and having a conical extension and including means for feeding thread thereto in a range of said conical extension to form a winding stock which is displaceable in a direction away from said conical extension and being removable over the head end, said winding body having a winding body section connected to said conical extension and defining an angle channel extending between said conical extension and said winding body section, at least one stay adjustably disposed in crossing overlapping arrangement relative to said angle channel, and means for setting said at least one stay in a radial direction relative to said winding body, said setting means including means for pivotally mounting said at least one stay at one end thereof for swinging said at least one stay in said radial direction.

8. The delivery device, as set forth in claim 1, wherein said means for fixedly adjusting said stays in position, for moving back said plurality of stays from said crossing projecting overlapping arrangement to coincidence with said angle channel.

9. The delivery device, as set forth in claim 1, wherein said plurality of stays constitutes a slide surface means for said thread which adjustably projects into said angle channel, said slide surface means for forming a detensioned slide-off thread section of the thread winding thereon.

10. The delivery device, as set forth in claim 1, wherein said plurality of stays is disposed immoveable circumferentially relative to said winding body.

11. The delivery device as set forth in claim 3, wherein said frustoconical surface and said jacket surface define at least one slot through which said at least one stay adjustably projects, respectively.

* * * * *